United States Patent [19]

Nichols

[11] 4,015,716

[45] Apr. 5, 1977

[54] CONTAINERS AND A CUSHION SUPPORT FOR USE THEREIN

[75] Inventor: Cyril Nichols, Maidstone, England

[73] Assignee: Leonard Gould & Company Limited, Maidstone, England

[22] Filed: Mar. 10, 1975

[21] Appl. No.: 556,872

[30] Foreign Application Priority Data

Mar. 11, 1974 United Kingdom ..... 10847/74

[52] U.S. Cl. ..... 206/521; 217/53; 217/65; 229/14 C; 248/24

[51] Int. Cl.[2] ..... B65D 81/04; B65D 85/38

[58] Field of Search ..... 206/521, 523; 229/14 C; 217/53, 65, 52; 248/22, 24, 350

[56] References Cited

UNITED STATES PATENTS

| | | | |
|---|---|---|---|
| 1,403,233 | 1/1922 | Collins | 217/65 |
| 2,674,433 | 4/1954 | Mautner | 217/52 |
| 2,960,249 | 11/1960 | Walsh | 217/65 |
| 3,334,798 | 8/1967 | Pezely, Jr. et al. | 217/65 |
| 3,410,474 | 11/1968 | Keil | 217/53 |

*Primary Examiner*—William T. Dixson, Jr.
*Attorney, Agent, or Firm*—Robert D. Yeager; Howard G. Massung

[57] ABSTRACT

This invention relates to an improved container or packaging case and to a cushion support for the packaging of an item or items in said container. The cushion support is so formed that when fitted to a container or packaging case the container or packaging case will if dropped from a specific height give protection for the item or items within the said container or the said packaging case.

The cushion support comprises a slab of a resilient material that depends from a support member by means of a groove adapted to co-operate slidably with a complementary tenon on the support member, the groove being substantially horizontally disposed on one face of the slab and opposed on the opposite face of the slab by a plurality of substantially vertically disposed grooves.

13 Claims, 12 Drawing Figures

CONTAINERS AND A CUSHION SUPPORT FOR USE THEREIN

This invention relates to an improved container or packaging case and to a cushion support for the packaging of an item or items in said container. The cushion support is so formed that when fitted to a container or packaging case the container or packaging case will if dropped from a specific height give protection for the item or items within the said container or the said packaging case.

According to the invention there is provided a cushion support comprising a slab of a resilient material, said cushion support being adapted to depend from a support member by means of a linear dovetail mortise groove adapted to co-operate slidably with a complementary dovetail tenon on said support member, said dovetail mortise groove being substantially horizontally disposed on one face of said slab and opposed on the opposite face of said slab by a plurality of substantially vertically disposed grooves.

According to a further feature of the invention there is provided a container or packaging case in which two or more cushion supports depend from a support member which is then placed within a surrounding structure.

In this specification by the term 'slab' is meant in general a flat, broad and comparatively thick mass preferably of rectangular parallelepiped form, and by the term 'dovetail' as used to qualify the terms 'mortise groove' and 'tenon' is meant not only the well known form haing the shape of a dove's tail but embraces inter alia simple T-shaped and half dumb-bell forms.

Clearly, in practice the cushion support will be used preferably in opposed pairs to support a support member in the form of a support board which will in most applications of packaging be a base board. The cushion support may be most conveniently used with a simple rectangular base board but the board may equally well be triangular, trapezoidal or polygonal and these forms may be regular or irregular depending upon the nature of the packaging case or container that is to carry it.

The invention will now be described, by way of example, with reference to the several figures of the accompanying drawing in which.

Figure 1:
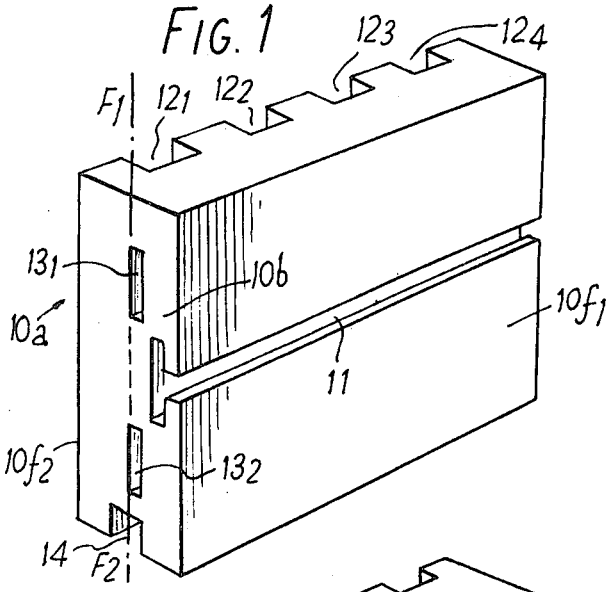
FIGS. 1 and 2 are views in oblique perspective of two forms of cushion support.

Referring now specifically to the figures of the drawing.

In FIG. 1 a cushion support shown generally at 10 comprises a rectangular parallelepiped preferably made from two parallelepipeds 10*a*, 10*b* of an expanded polythene such as that known under the Registered Trade Name owned by Dow Chemical Limited, viz. ETHAFOAM. The two parallelepipeds 10*a*, 10*b* are joined along the planar interface represented by FIG. 1 by the line $F_1$, $F_2$. Clearly the parallelepiped 10 may be a single extruded block substantially machined as desired. The cushion support has a substantially horizontally disposed linear dovetail mortise groove 11 of T-form in one face, viz. $10f_1$ and this groove 11 is opposed on the opposite face $10f_2$ by a plurality of substantially vertically disposed grooves $12_1$, $12_2$, $12_3$, $12_4$. The cushion support also has two internal passages $13_1$, $13_2$ substantially horizontally disposed and an open groove 14.

Figure 2:
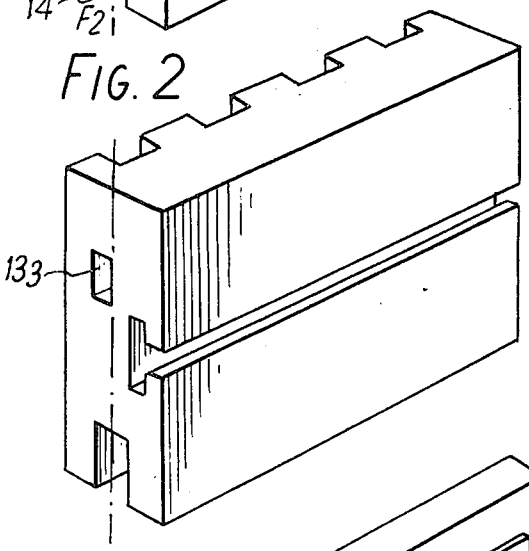

Th cushion support of FIG. 2 is similar to that of FIG. 1 but it has only one internal passage $13_3$.

Figure 3:
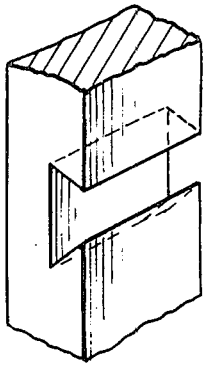
FIGS. 3 and 4 are scrap views of alternative forms of dovetail mortise grooves.
Figure 4:
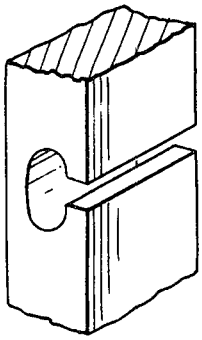

The dovetail mortise groove may clearly take a variety of forms and two are shown in FIGS. 3 and 4. The groove of FIG. 3 has the well known dovetail form as widely used in the slides of lathes and other machine tools. The groove of FIG. 4 has the well known half dumb-bell form used in the slides of inter alia commutator bars and turbine blade roots.

Figure 5:
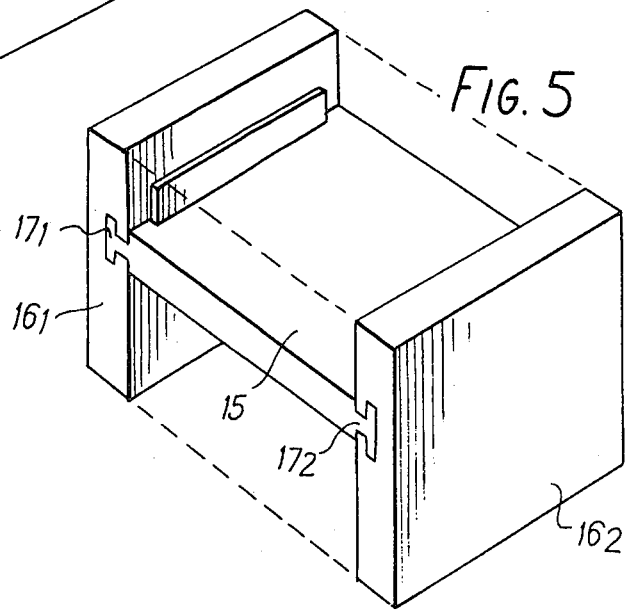
FIGS. 5, 6 and 7 are views in oblique perspective of three containers with various forms of support member with cushion supports attached thereto.

It is preferred to use the cushion supports of FIGS. 1 and 2 in opposed pairs as shown in use in FIG. 5 with a support member in the form of a rectangular base board 15, the cushion supports $16_1$, $16_2$ depending from the base board 15 and being held thereto by complementary dovetail tenons $17_1$, $17_2$.

Figure 6:
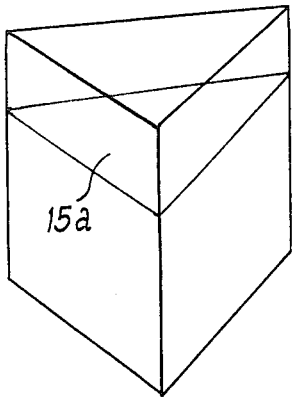
Figure 7:
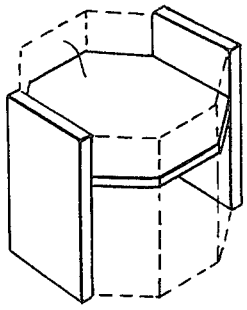

The rectangular base board 15 may take a variety of forms, two of which are shown in FIGS. 6 and 7. In FIG. 6, the board 15*a* is triangular and in FIG. 7 the board 15*b* is polygonal. Clearly, in the board of FIG. 6 three cushion supports would be used and in the board of FIG. 7 any number of cushion supports may be used from two to *n*, where *n* is the number of sides of the polygon. Again, the rectangular base board 15 or indeed support board of FIG. 5 may have four dovetail tenons $17_2$, $17_3$ (tenons $17_1$, $17_4$ being invisible) each having the form of a T shown in the sectional view of FIG. 9 where the board 15 is seen to have a two-part tenon 17*a*, 17*b* and a vertical wall structure 18.

Figure 9:
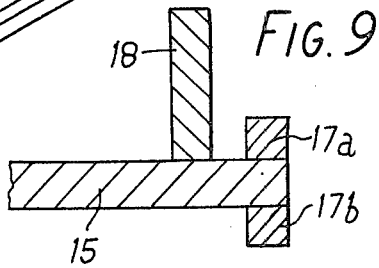
Figure 10:
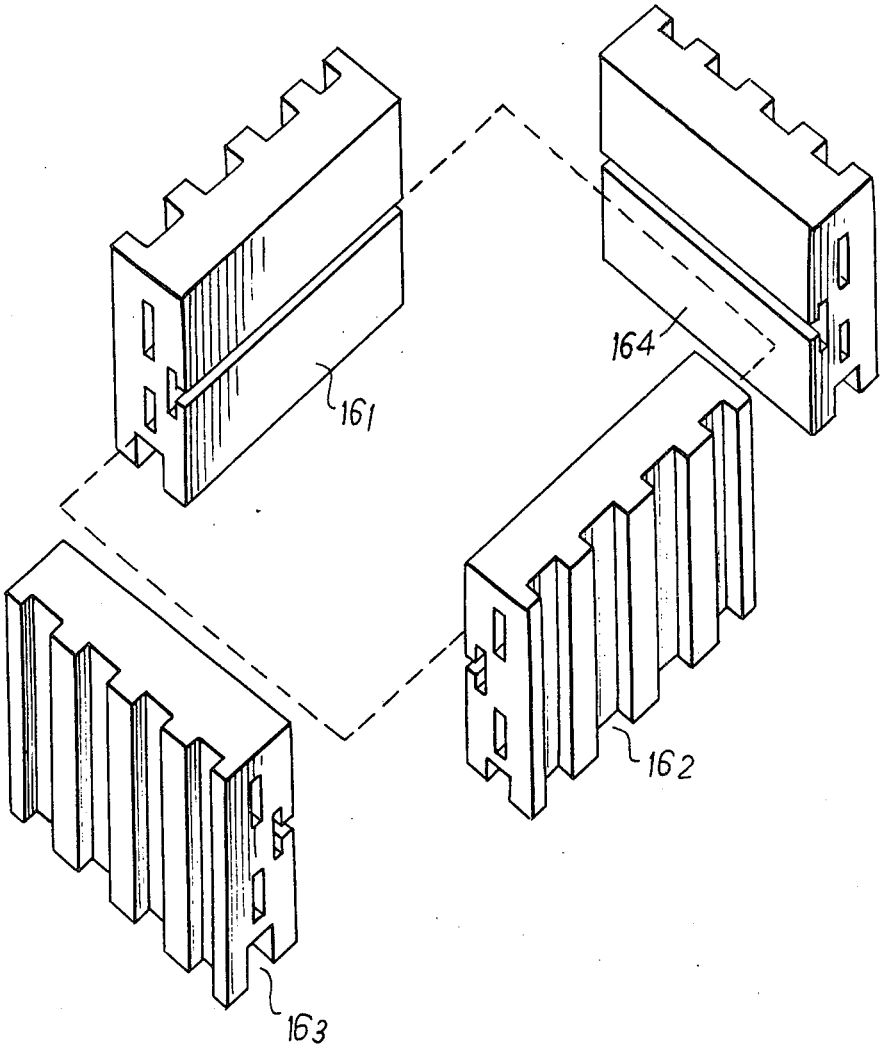
FIG. 10 is a pseudo-isometric view of four cushion supports disposed one at each side of the support board (shown dotted) of FIG. 8 and for use in a container.

The support board 15 of FIG. 9 is supported by four cushion supports $16_1$, $16_2$, $16_3$, $16_4$ disposed as shown in FIG. 10 which depend respectively from the tenons $17_1$, $17_2$, $17_3$, $17_4$ of support board 15 (shown dotted in FIG. 10).

Figure 8:
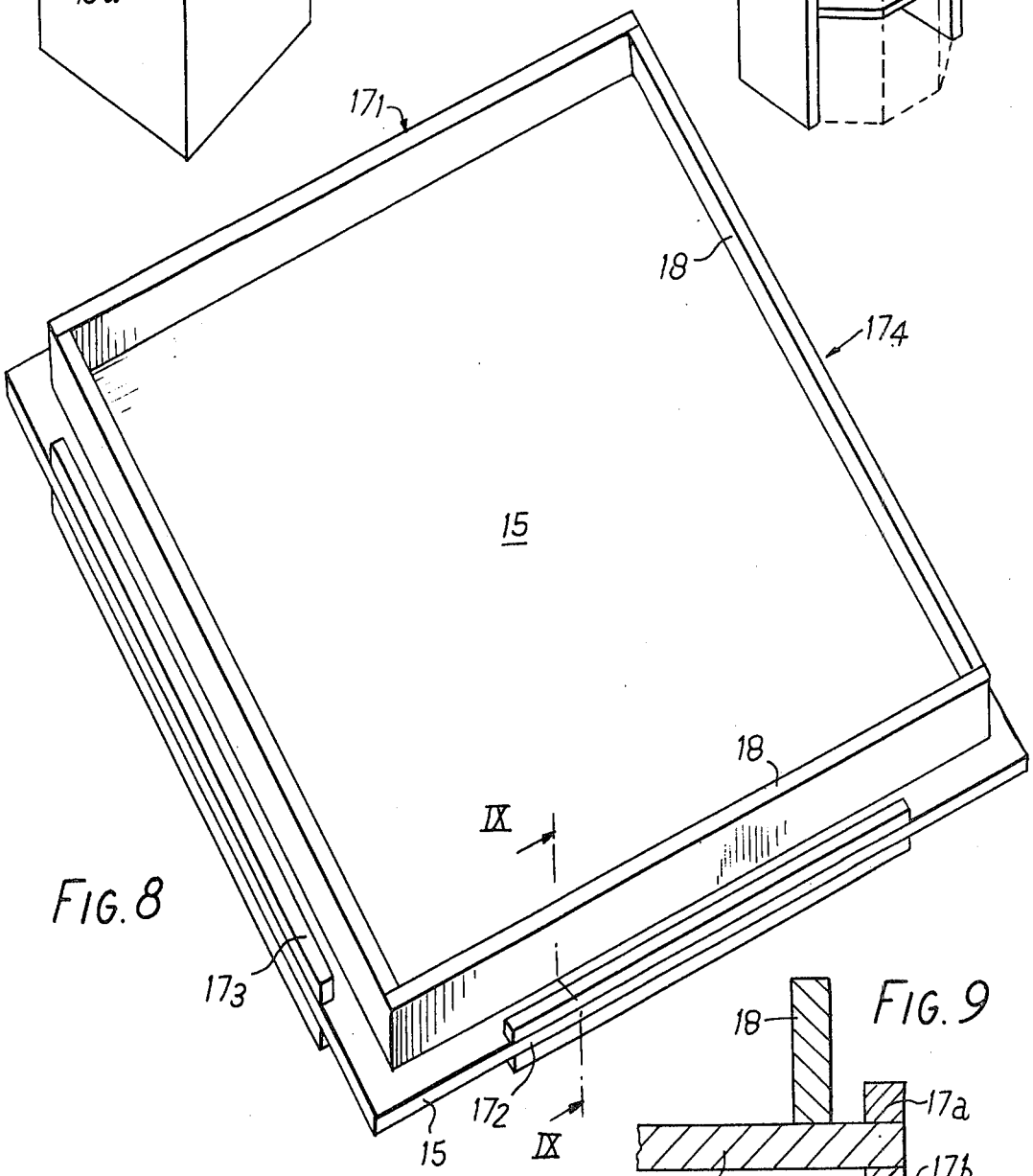
FIG. 8 is a pseudo-isometric view of a support board and FIG. 9 is a scrap section on the section station IX—IX of FIG. 8.
Figure 11:
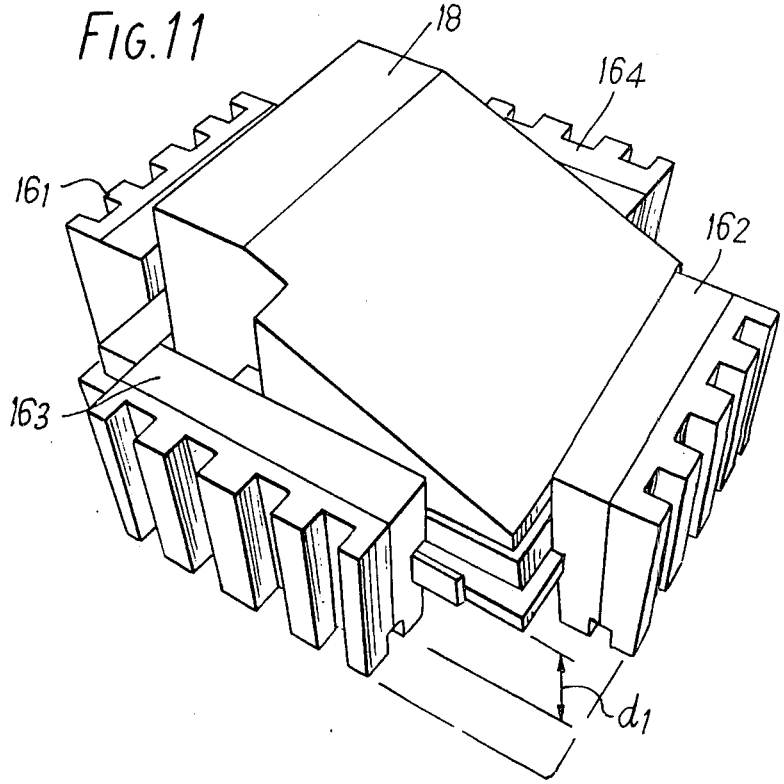
FIGS. 11 and 12 are views in oblique three point perspective of an item packaged by surrounding it on four sides with four cushion supports as shown in FIG. 1 or FIG. 2 and within a container or packaging case shown dotted.
Figure 12:
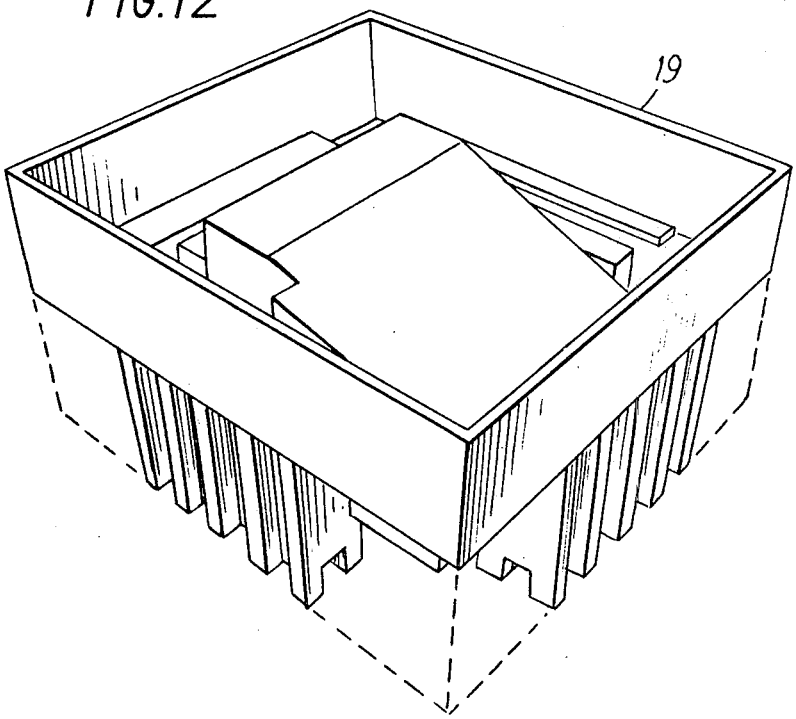

Referring now to FIGS. 11 and 12, an item to be packaged 18 is shown supported by four cushion supports $16_1$, $16_2$, $16_3$, $16_4$ as shown in FIGS. 8, 9 and 10. The item 18 is completely supported in this example a distance $d_1$ above the surface on which the cushion supports stand (FIG. 12). A linear 19 is placed on top of the four cushion supports which abuts with the top of a container that contains the item and its supports. The linear 19 prevents the base board and cushion from rising to the top of the container should the container be dropped. In fact, what happens is that the cushion supports move sufficiently to decelerate the movement of the item inside the package and absorb the shock.

In one packaging case or container using an arrangement as shown in FIGS. 8, 9, 10, 11 and 12 with an item 18 having a weight of 76 lb. (34400g) dropped from a height of 3.28 ft. (1 m) with four cushion supports of Ethafoam having a depending length ($d_1$) of 6 inches (152 mm) the item was not in any way damaged by the forces generated when following the drop it was arrested by the ground. The use of such cushion supports enables a container of outer size, for example, of 36 × 34 × 21 inches (910 × 860 × 530 mm) to achieve a fragility factor of 25.

The cushion supports of the present invention are a great aid to packaging in that they allow the following desiderata to be achieved:

A successful system for packaging fragile equipment.

A system that will accommodate units over a wide variety of weights from 2 lb. up to 150 lb. (0.9 kg to 68 kg).

They dispense with the use of a primary pack, or squaring off a packaged unit.

The cushioning system can be tailored to suit customer's requirements for either sea, air, rail or road transportation.

The packaged unit is easily viewable immediately the outer case is opened.

The use of a desiccant for tropicalization of the packaged unit is easily accommodated and the use of dunnage material within the package is minimized.

The overall weight of the container and the packaged unit is reduced, giving a considerable saving in air freight costs.

The cushioning system can be used when the packaged unit is removed from the transporting container, allowing protection of the unit against shock whilst in storage.

The cushioning system can be attached or detached from its carrying base by sliding on or off and a smaller size cushion support can easily be used for lesser hazards within the stores or manufacturing plant should it be necessary.

The dynamic forces generated by mishandling are not transmitted to the actual faces of the packaged unit per se. No bearing needs to be taken on sides, ends and top of the packaged unit.

What I claim is:

1. A cushion support structure for use in packaging, comprising:

a first resilient slab member having a linear dovetail mortise groove formed in a first surface thereof;

a second resilient slab member having a linear dovetail mortise groove formed in a first surface thereof;

a support member shaped in a flat polygonal form having formed on each of at least two edges a dovetail tenon complementary with the dovetail mortise grooves of said first and second slab members and being slidable therein; and, said first and second resilient slab members depending from said support member positioning said support member in spaced apart relation from the bottom edges of said first and second resilient slab members.

2. A cushion support structure as recited in claim 1 wherein:

the surface of said first resilient slab member opposite the first surface has a plurality of grooves arranged substantially at right angles to said dovetail mortise groove; and, the surface of said second resilient slab member opposite the first surface has a plurality of grooves arranged substantially at right angles to said dovetail mortise groove.

3. A cushion support structure as recited in claim 1 wherein the linear mortise groove in said first and second resilient slab members has the form of a T.

4. A cushion support structure as recited in claim 1 wherein the linear mortise groove in said first and second resilient slab members has the form of a half dumb-bell.

5. A container comprising:

a support member, having formed thereon dovetail tenons, for supporting an item;

a first resilient slab member having a linear dovetail mortise groove formed therein complementary with one of said dovetail tenons formed on said support member and depending from said support member;

a second resilient slab member having a linear dovetail mortise groove formed therein complementary with one of said tenons formed on said support member and depending from said support member;

an enclosure disposed around said support member, said first resilient slab member and said second resilient slab member; and said support member comprises a rigid board having edges disposed to define a polygonal form and at least two edges of said polygonal shaped support member each are provided with a dovetail tenon cooperating with a complementary groove in said first or second resilient slab member positioning said support member in spaced apart relationship from the bottom of said enclosure.

6. A container as claimed in claim 5 wherein:

the sides of said first resilient slab member and said second resilient slab member, opposite the linear dovetail mortise groove formed therein, have a plurality of grooves formed therein extending transverse the linear dovetail mortise groove.

7. A container as claimed in claim 6 wherein:

the linear dovetail mortise grooves formed in said first and second resilient slab members has the form of a T.

8. A container as claimed in claim 6 wherein:

the linear dovetail mortise grooves formed in said first and second resilient slab members has the form of a half dumb-bell.

9. A cushion support structure for use in packaging comprising:

a relatively flat rigid base support board, having a polygonal form for supporting an item to be packed, having a tenon formed at portions of the periphery thereof; and, a plurality of cushion supports each engaging said tenon of said rigid base support board and depending from said base support board for resiliently supporting said relatively rigid base support board above the bottom of said plurality of cushion supports.

10. A cushion support structure as claimed in claim 9 wherein said cushion support means comprises:

a slab of resilient material having a linear mortise groove adapted to co-operate slidably with the tenon formed on said relatively rigid base support board.

11. A cushion support structure as claimed in claim 10 wherein:

the linear mortise groove formed in said slab of resilient material has the form of a T.

12. A cushion support structure as claimed in claim 10 wherein:

the linear mortise groove formed in said slab of resilient material has the form of a half dumb-bell.

13. A cushion support structure as claimed in claim 10 wherein:

a plurality of grooves are formed on the side of said slab of resilient material opposite said linear mortise groove extending transverse to said linear mortise groove.

* * * * *